US008997899B2

(12) United States Patent
Stowe, II

(10) Patent No.: US 8,997,899 B2
(45) **Date of Patent: *Apr. 7, 2015**

(54) CUTTING ELEMENT, CUTTER TOOL AND METHOD OF CUTTING WITHIN A BOREHOLE

(75) Inventor: Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 44 days.

This patent is subject to a terminal disclaimer.

(21) Appl. No.: 13/492,267

(22) Filed: Jun. 8, 2012

(65) Prior Publication Data

US 2013/0140090 A1 Jun. 6, 2013

Related U.S. Application Data

(63) Continuation-in-part of application No. 12/700,845, filed on Feb. 5, 2010.

(51) Int. Cl.

| | |
|---|---|
| ***E21B 10/46*** | (2006.01) |
| ***E21B 7/00*** | (2006.01) |
| ***E21B 10/56*** | (2006.01) |

(52) U.S. Cl.

CPC . *E21B 10/46* (2013.01); *E21B 7/00* (2013.01); *E21B 10/56* (2013.01)

(58) Field of Classification Search

USPC ..... 175/376, 398, 401, 426, 430, 431; 407/113–117, 102–109; 30/353, 357

See application file for complete search history.

(56) References Cited

U.S. PATENT DOCUMENTS

| | | | |
|---|---|---|---|
| 4,978,258 | A | 12/1990 | Lins |
| 5,971,676 | A | 10/1999 | Kojima |
| 6,464,434 | B2 | 10/2002 | Lynde |
| 6,672,406 | B2 | 1/2004 | Beuershausen |
| 7,048,080 | B2 | 5/2006 | Griffo et al. |
| 7,121,772 | B2 | 10/2006 | Krahula et al. |
| 7,363,992 | B2 | 4/2008 | Stowe et al. |
| 7,377,340 | B2 | 5/2008 | McDonough |
| 7,543,661 | B2 | 6/2009 | Griffo et al. |
| 7,703,559 | B2 | 4/2010 | Shen et al. |
| 8,434,572 | B2 | 5/2013 | Stowe, II et al. |

(Continued)

FOREIGN PATENT DOCUMENTS

| | | | |
|---|---|---|---|
| GB | 2450936 | A | 1/2009 |
| JP | 09150304 | A | 6/1997 |

OTHER PUBLICATIONS

Cutting & Wear—Hardfacing & Engineering for the Energy Industry; "Materials, equipment and services for oil companies"; Product Catalog; www.cwuk.com, South Yorkshire, United Kingdom.

(Continued)

*Primary Examiner* — Nicole Coy
*Assistant Examiner* — Taras P Bemko
(74) *Attorney, Agent, or Firm* — Cantor Colburn LLP

(57) ABSTRACT

A cutting element includes a modified gilmoid having two planes defining a plurality of cutting edges thereon, and a first support extending from a central area of a first of the two planes and a second support extending from a central area of a second of the two planes. The supports are sized and positioned such that when the cutting element is resting against a planar surface such that one of the plurality of cutting edges and the first support are in contact with the planar surface the first plane forms an acute angle with the planar surface.

48 Claims, 8 Drawing Sheets

(56) References Cited

U.S. PATENT DOCUMENTS

| | | | | |
|---|---|---|---|---|
| 2002/0139582 | A1 | 10/2002 | Caraway et al. | |
| 2003/0031520 | A1 | 2/2003 | Hintze et al. | |
| 2004/0129420 | A1 | 7/2004 | Hart et al. | |
| 2005/0047885 | A1 | 3/2005 | Hyatt et al. | |
| 2005/0178587 | A1 | 8/2005 | Witman, IV et al. | |
| 2005/0284659 | A1 | 12/2005 | Hall et al. | |
| 2007/0107940 | A1 | 5/2007 | Lockstedt et al. | |
| 2007/0169937 | A1 | 7/2007 | Allin et al. | |
| 2007/0267221 | A1 | 11/2007 | Giroux et al. | |
| 2007/0278017 | A1 | 12/2007 | Shen et al. | |
| 2008/0142270 | A1 | 6/2008 | Haglund | |
| 2008/0164071 | A1* | 7/2008 | Patel et al. | 175/431 |
| 2008/0264690 | A1 | 10/2008 | Khan et al. | |
| 2009/0032307 | A1 | 2/2009 | Meyer et al. | |
| 2009/0260878 | A1 | 10/2009 | Morley et al. | |
| 2009/0283326 | A1 | 11/2009 | Oothoudt | |
| 2011/0192653 | A1 | 8/2011 | Stowe, II | |
| 2011/0203856 | A1 | 8/2011 | Lynde et al. | |
| 2011/0308865 | A1 | 12/2011 | Stroud et al. | |
| 2012/0073880 | A1 | 3/2012 | Lynde | |

OTHER PUBLICATIONS

Cutting & Wear Website, "Cutting Inserts," http://www.cwuk.com/page390.asp; accessed Jan. 5, 2010.

Notification of Transmittal of the International Search Report and the Written Opinion of the International Searching Authority; PCT/US2011/023698; Korean International Patent Office; Mailed Sep. 27, 2011; ISR 5 pages; WO 3 pages.

Notification of Transmittal of the International Search Report and the Written Opinion of the International Searching Authority; PCT/US2013/039393; Korean International Patent Office; Mailed Sep. 17, 2013; 13 pages.

* cited by examiner

CUTTING ELEMENT, CUTTER TOOL AND METHOD OF CUTTING WITHIN A BOREHOLE

CROSS REFERENCE TO RELATED APPLICATION

This application is a continuation-in-part application of U.S. patent application Ser. No. 12/700,845, filed Feb. 5, 2010, the entire contents of which are incorporated herein by reference.

BACKGROUND

Cutting tools, such as mills used in downhole applications, for example, can be made with a plurality of cutting elements that are adhered to a surface of a tool. The cutting elements can be randomly shaped particles made by fracturing larger pieces. Alternately, cutting elements can be precisely formed into repeatable shapes using processes such as machining and molding, for example. Regardless of the process employed to make the individual cutting elements the elements are typically adhered to the mill with random orientations. These random orientations create disparities in maximum heights relative to a surface of the mill. Additionally, large disparities may exist between the heights of the portions of the cutting elements that engage the target material during a cutting operation. Furthermore, angles of cutting surfaces relative to the target material are randomized and consequently few are near preferred angles that facilitate efficient cutting. Apparatuses and methods to lessen the foregoing drawbacks would therefore be well received in the industry.

BRIEF DESCRIPTION

Disclosed herein is a cutting element. The cutting element includes a modified gilmoid having two planes defining a plurality of cutting edges thereon, and a first support extending from a central area of a first of the two planes and a second support extending from a central area of a second of the two planes are sized and positioned such that when the cutting element is resting against a planar surface such that one of the plurality of cutting edges and the first support are in contact with the planar surface the first plane forms an acute angle with the planar surface.

Further disclosed herein is a cutter tool. The cutter tool includes a body with at least one planar surface, and a plurality of the cutting elements are attached to the at least one planar surface with a plurality of the plurality of cutting elements are oriented such that the first support and at least one cutting edge is in contact with the at least one planar surface. The cutting elements having a modified gilmoid having two planes defining a plurality of cutting edges thereon, and a first support extending from a central area of a first of the two planes and a second support extending from a central area of a second of the two planes sized and positioned such that when the cutting element is resting against a planar surface such that one of the plurality of cutting edges and the first support are in contact with the planar surface the first plane forms an acute angle with the planar surface.

Further disclosed herein is a method of cutting within a borehole. The method includes rotating a cutter tool disclosed herein within a borehole, contacting a target in the borehole with one or more of the plurality of cutting elements, and cutting the target.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
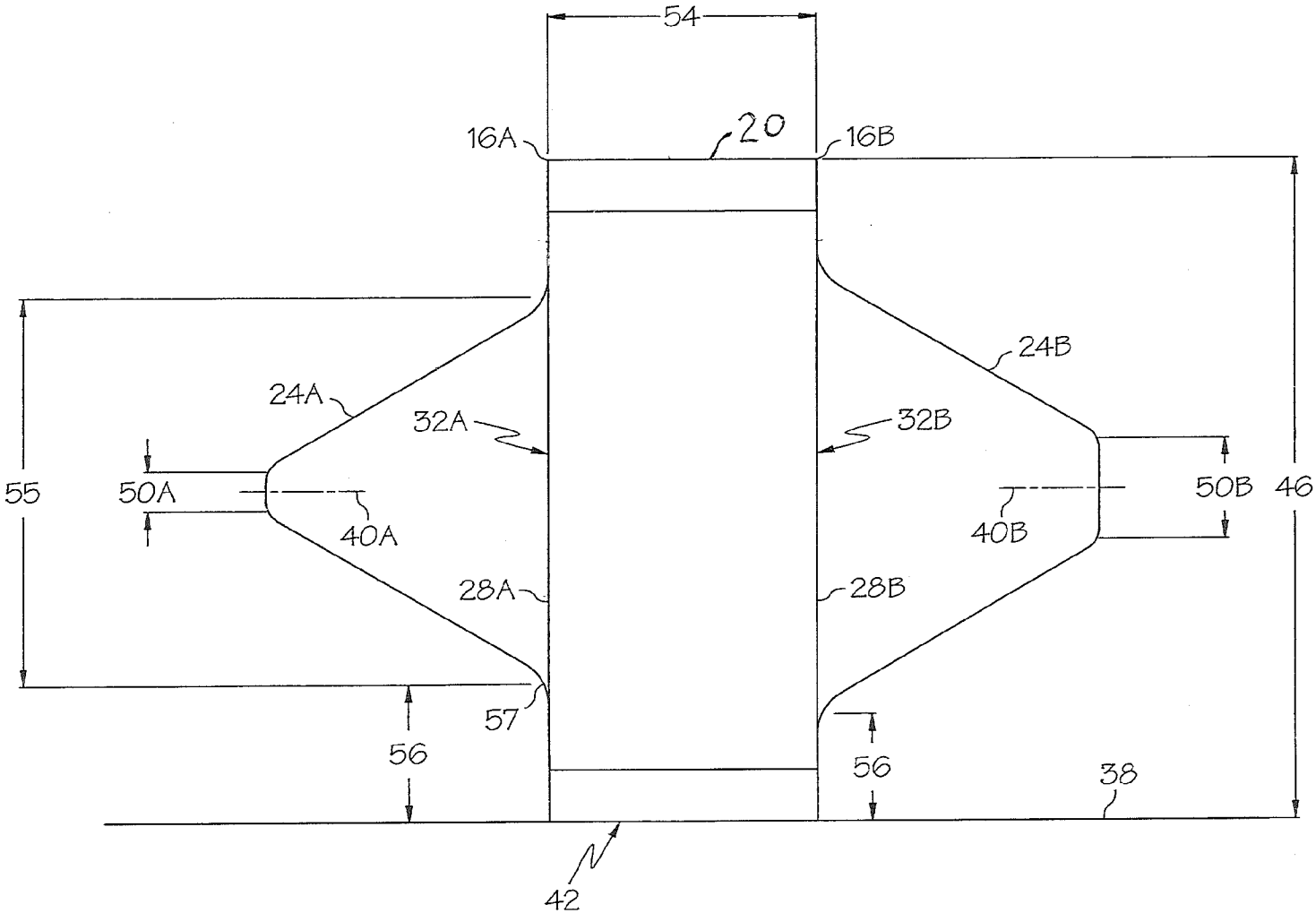
FIG. 1 depicts a side view of a cutting element disclosed herein.

Referring to FIG. 1, an embodiment of a cutting element disclosed herein is illustrated at 10. The cutting element 10 includes, a central portion 20 disclosed herein as a gilmoid or a modified gilmoid 120, as will be described in detail below with reference to FIGS. 5-6 and 7-8 respectively. The gilmoid 20 defining a plurality of cutting edges 16A, 16B, having two supports 24A and 24B that extend beyond surfaces 32A and 32B, the surfaces 32A and 32B defining certain volumetric boundaries of the gilmoid 20. In this embodiment the supports 24A and 24B are not symmetrical to one another to produce a biasing force in response to gravity acting thereon toward a surface 38, such that one of the supports 24A, 24B and one of the cutting edges 16A, 16B are in contact with surface 38. For some embodiments herein the surface 38 is a planar surface. Additionally, the supports 24A, 24B in this embodiment have a pyramidal shape.

Figure 2:
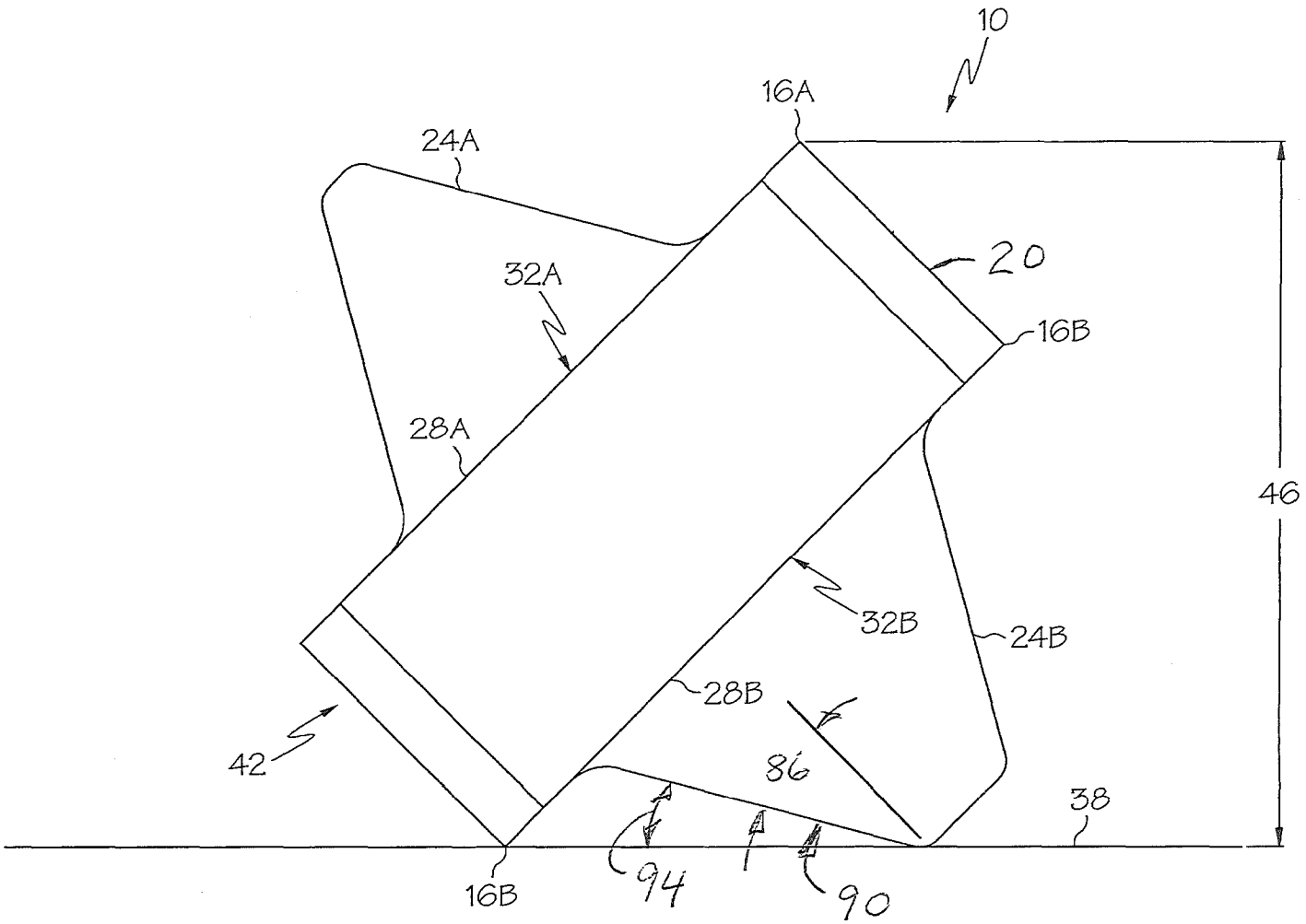
FIG. 2 depicts another side view of the cutting element of FIG. 1, shown resting at an alternate orientation on a surface.
Figure 3:
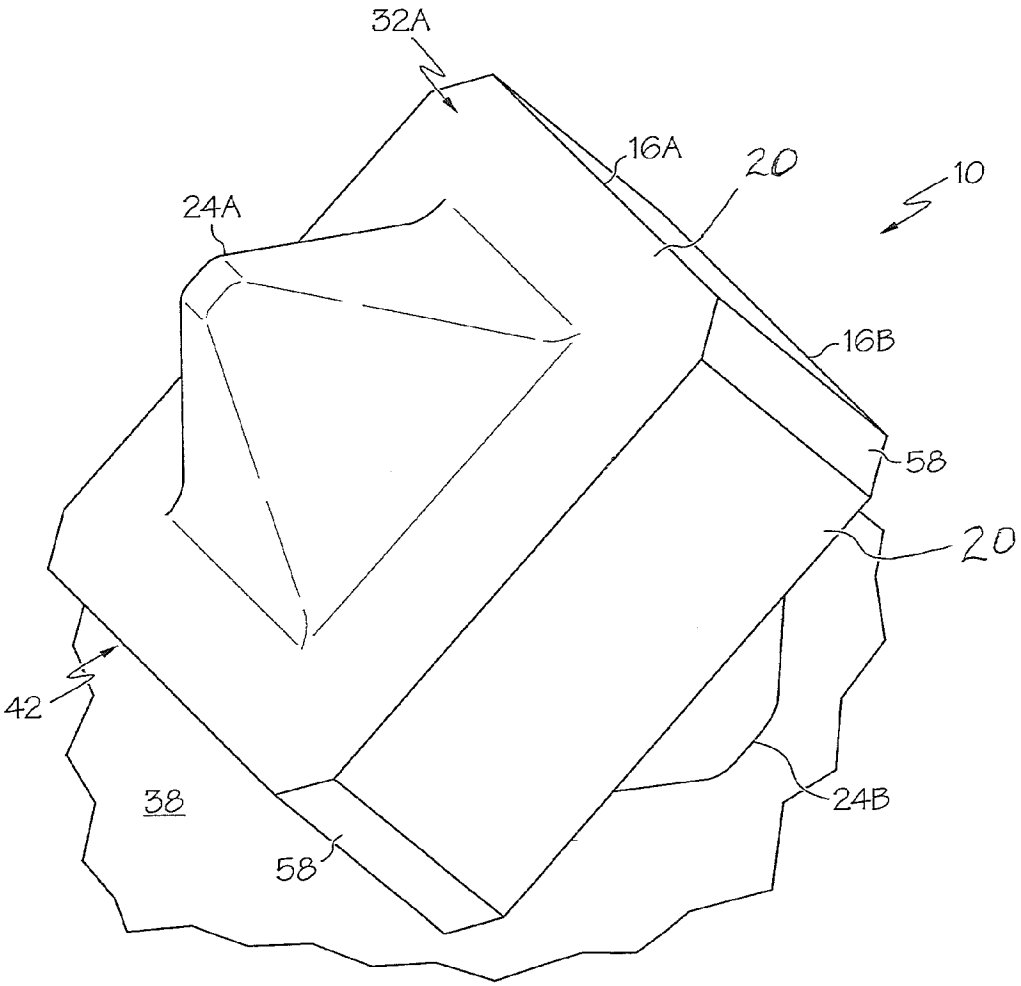
FIG. 3 depicts a perspective view of the cutting element of FIGS. 1 and 2, shown resting at the orientation of FIG. 2.

Referring to FIGS. 2 and 3, the biasing forces tend to cause the cutting element 10 to reorient from the position illustrated in FIG. 1 to the position illustrated in FIGS. 2 and 3. The cutting element 10, as illustrated in FIGS. 2 and 3, is resting on the surface 38 such that both the support 24B and one of the cutting edges 16B is in contact with the surface 38. The cutting edges 16A, in this position, are oriented with the surface 32A at an approximately 45 degree (and preferably between 35 and 55 degrees) angle relative to the surface 38, and represent a preferred cutting orientation that can cut with greater efficiency than alternate angles. In contrast, the cutting element 10 in FIG. 1 is positioned such that just one face 42, defined between the two cutting edges 16A and 16B, is in contact with the surface 38. In this position a longitudinal axes of the gilmoid 20 is substantially parallel with the surface 38. Additionally, although axes 40A, 40B of the supports 24A, 24B are illustrated herein with an angle of 180 degrees between them, angles of 120 degrees or more are contemplated.

The cutting element 10 is further geometrically configured so that when the cutting element 10 is resting on the surface 38, regardless of its orientation, a dimension 46 to a point on the cutting element 10 furthest from the surface 38 is substantially constant. This assures a relatively even distribution of cutting forces over a plurality of the cutting elements 10 adhered to the surface 38.

The foregoing structure allows a plurality of the cutting elements 10 to be preferentially oriented on the surface 38 prior to being fixedly adhered to the surface 38. While orientations of each of the cutting elements 10 is random in relation to a direction of cutting motion the biasing discussed above orients a majority of the cutting elements 10 as shown in FIGS. 2 and 3 relative to the surface 38. Having a majority of the cutting elements 10 oriented as shown in FIGS. 2 and 3 improves the cutting characteristics of a cutter employing these cutting elements 10 over cutters employing non-biasing cutting elements.

The supports 24A and 24B illustrated herein are geometrically asymmetrical, as is made obvious by the difference in widths 50A and 50B of the supports 24A and 24B, respectively. This asymmetry creates the asymmetrical bias discussed above in response to gravitational forces acting on the cutting element 10 in a direction parallel to the surfaces 32A, 32B. Alternate embodiments are contemplated that have supports that are geometrically symmetrical while providing the asymmetrical bias with gravity. A difference in density between such supports is one way to create such an asymmetrical gravitational bias with geometrically symmetrical supports.

A width 54 of the central portion 20, defined between the planes 28A and 28B, can be set large enough to provide strength sufficient to resist fracture during cutting while being small enough to allow the gravitational asymmetrical bias on the cutting element 10 to readily reorient the cutting element 10 relative to the surface 38 and be effective as a cutting element.

Additionally in this embodiment, by making a base dimension 55, defined as where the supports 24A, 24B intersects with a central area 64 of the surfaces 32A, 32B of the planes 28A, 28B, smaller than the dimension 46, a right angled intersection is defined at the cutting edges 16A, 16B. A distance 56 between an intersection 57 of the supports 24A, 24B with the surfaces 32A, 32B and the faces 42, 58, 62 provides a space where the material being cut can flow and can create a barrier to continued propagation of a crack formed in one of the cutting edges 16A, 16B beyond the intersections 57. Preferably, the base dimension 55 is sized to be between 40 and 80 percent of the dimension 46 and more preferably about 60 percent. The 40 to 80 percent requirement combined with the 35 to 55 degree angle limitation discussed above results in flank angle 86 values of between about 15.6 and 29 degrees wherein the flank angle 86 is defined as the angle between a flank face 90 and an axis of the support that is substantially perpendicular to the at least one plane 32B. Additionally, the flank face 90 forms an angle 94 of between about 19.4 and 26 degrees relative to the surface 38.

Figure 4:
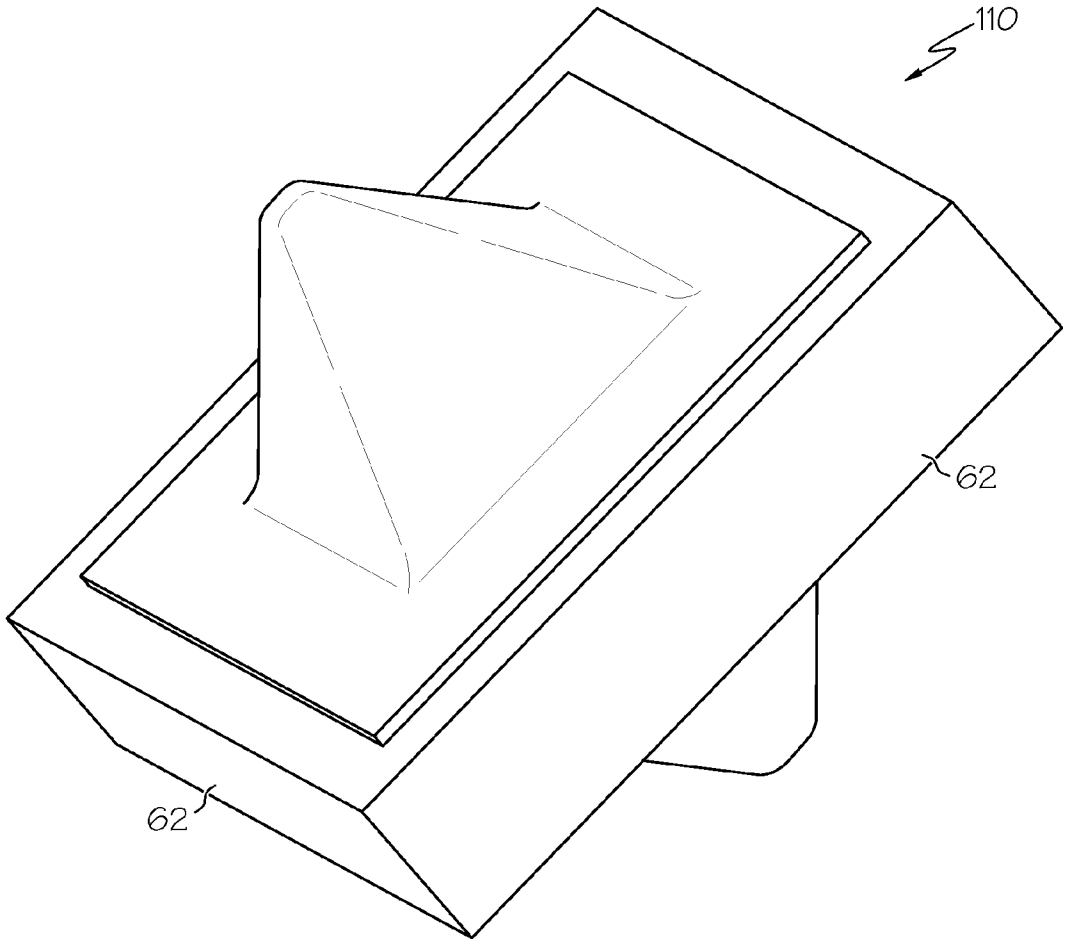
FIG. 4 depicts a perspective view of an alternate embodiment of a cutting element disclosed herein.

Referring to FIG. 3, additional faces 58 defined between the cutting edges 16A and 16B can be incorporated as well. In fact, any number of faces 42, 58 can be provided between the cutting edges 16A and 16B thereby forming a polygonal prism of the central portion 20, including just four faces 62 as illustrated in FIG. 4 in an alternate embodiment of a cutting element 110 disclosed herein.

The cutting elements 10, 110 disclosed herein may be made of hard materials that are well suited to cutting a variety of materials including, for example, those commonly found in a downhole wellbore environment such as stone, earth and metal. These hard materials, among others, include steel, tungsten carbide, tungsten carbide matrix, polycrystalline diamond, ceramics and combinations thereof. However, it should be noted that since polycrystalline diamond is not a required material some embodiments of the cutting elements 10, 110 disclosed may be made of hard materials while excluding polycrystalline diamond therefrom.

Figure 6:
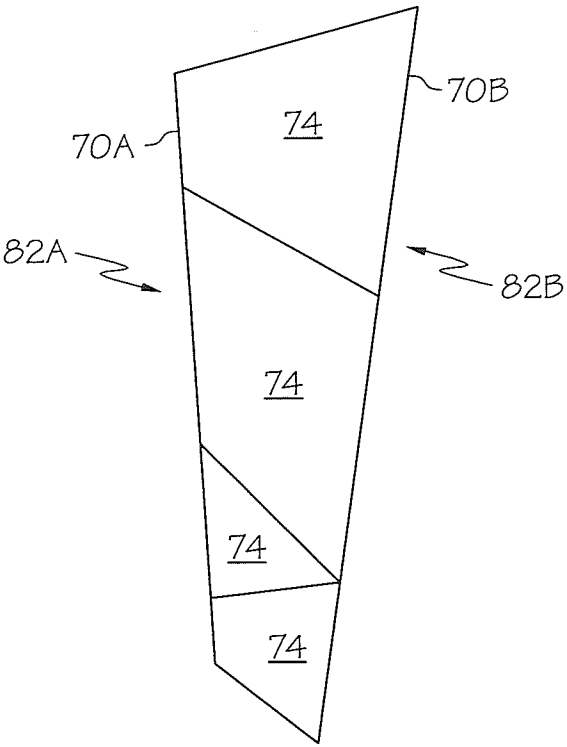
FIG. 6 depicts a side view of the central portion of the cutting element of FIG. 5.
Figure 5:
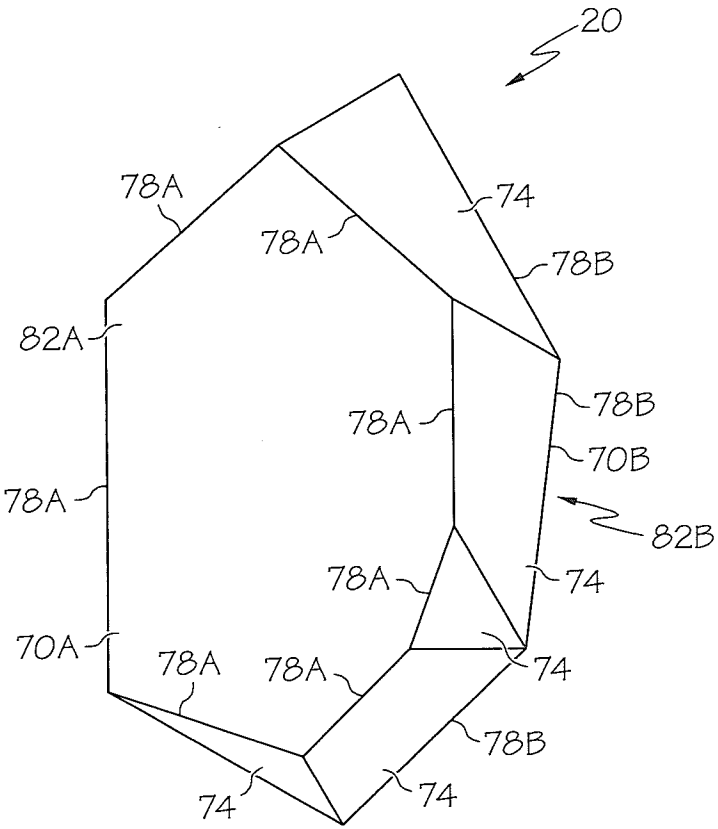
FIG. 5 depicts a perspective view of a central portion of the cutting element.

Although the embodiments discussed above are directed to a central portion 20 that is a polygonal prism, alternate embodiments can incorporate a central portion 20 that has fewer constraints than is required of a polygonal prism. As such, the term gilmoid has been introduced to define the requirements of the central portion 20. Referring to FIGS. 5 and 6, the gilmoid 20 is illustrated without supports 24A, 24B shown. The gilmoid 20 is defined by two polygons 70A, 70B with surfaces 74 that connect sides 78A of the polygon 70A to sides 78B of the other polygon 70B. The two polygons 70A, 70B can have a different number of sides 78A, 78B from one another, and can have a different area from one another. Additionally, planes 82A, 82B, in which the two polygons 70A, 70B exist, can be parallel to one another or can be nonparallel to one another, as illustrated.

Figure 8:
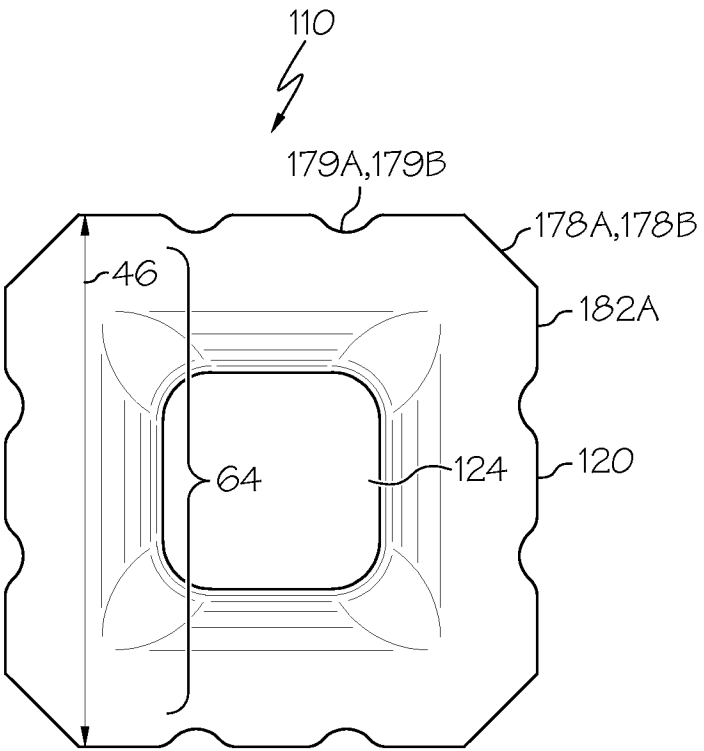
FIG. 8 depicts an end view of the cutting element of FIG. 7.
Figure 7:
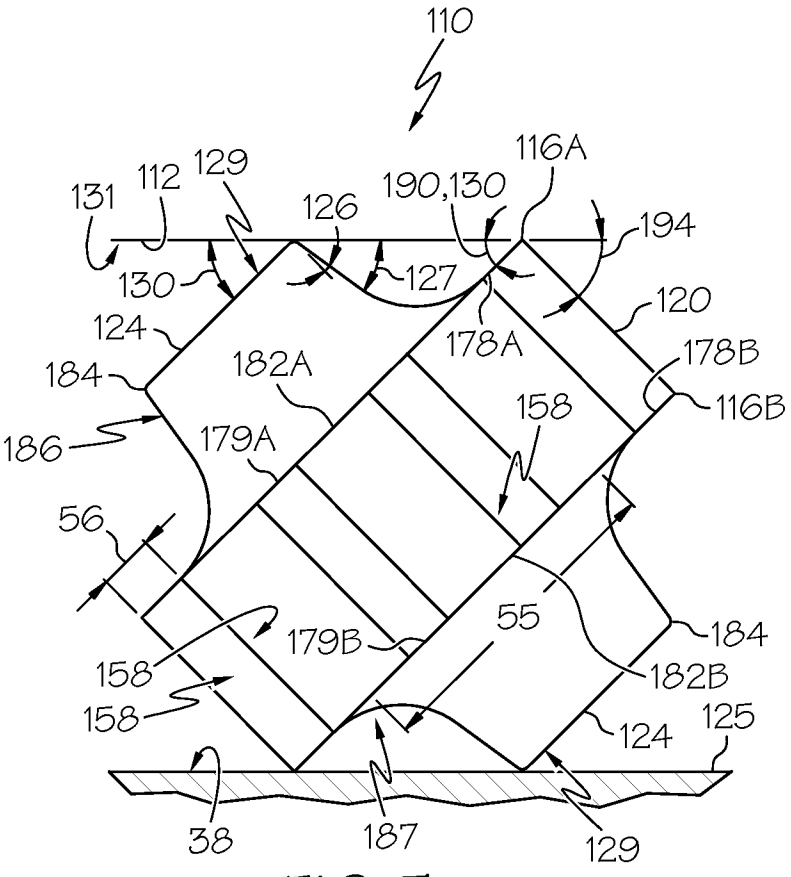
FIG. 7 depicts a side view of another cutting element disclosed herein.

Referring to FIGS. 7 and 8, an alternate embodiment of a cutting element is illustrated at 110. One aspect that differentiates the cutting element 110 from the cutting element 10 is that central portion 120 allows for additional variations beyond those identified by the gilmoid 20. While the gilmoid 20 requires that planes 82A and 82B be polygons, and by the definition of a polygon have straight sides 78A and 78B, the central portion 120 can have planes 182A and 182B with either or both straight sides 178A and 178B and non-straight portions 179A, 179B such as the curved portions illustrated. As such, herein the central portion 120 will be referred to as a "modified gilmoid." As with the gilmoid 20 the planes 182A, 182B of the modified gilmoid 120 need not be symmetrical or even geometrically similar to one another even though in the embodiments illustrated herein they are geometrically similar. In fact, the modified gilmoid (central portion 120) as illustrated herein is symmetrical as is the cutting element 110.

One potential advantage of including the curved portions 179A, 179B illustrated herein is that sizes of chips or detritus formed during fracturing of the cutting element 110 during a cutting operation can be limited. This limitation is due to a crack propagating during a fracture intersecting with the curved portions 179A, 179B thereby preventing the crack from propagating through a larger dimension of the cutting element 110. Regardless of whether the curved portions 179A, 179B are employed, cutting edges 116A, 116B defined by intersections of the planes 182A, 182B with faces 158 connect the straight sides 178A and non-straight portions 179A of the plane 182A to the straight sides 178B and non-straight portions 179B of the plane 182B.

The cutting element 110 also differs from the element 10 in that supports 124 extending from the planes 182A, 182B are symmetrical to one another. Although such symmetry is not required, it may simplify fabrication thereof without having a detrimental impact on the effectiveness of the cutting element 110. Additionally, corners 184 of the supports 124 can also serve as cutting edges. The supports 124 in this embodiment have a pyramidal shape with a flank angle 126 defined between a support face 129 and a flank face 186 of about 10 degrees (although a conical shape is also contemplated, see FIGS. 12, 14 and 15). Although the pyramid flank angle 126 can be set at other values, such as 20 and 27 degrees, for example, significant increases therein may decrease a cutting angle 127 that is defined as the angle between the flank face 186 of the support 124 and a surface 131 of a target 112, or work piece, being cut by the element 110. A decrease in the cutting angle 127 may contribute to less effective cutting by the support 124. Additionally, decreasing the pyramid flank angle 126 can make fabrication of the cutting element 110 more difficult and can increase chances of the support 124 being broken off in smaller pieces. In an embodiment where the support face 129 is parallel to the plane 182A, angle 130 defined between both the support face 129 and the surface 131 of the target 112 and the plane 182A and the surface 131 are the same, as long as the surface 131 of the target 112 is planar.

As with the cutting element 10, the cutting element 110 is configured such that when the cutting element 110 is resting on the substantially planar surface 38 (such as a surface of a cutter tool 125 to which the cutting element 110 is attached) the plane 182B forms an acute angle with the surface 38. Additionally, in the embodiments illustrated the cutting edges 116A or 116B are oriented at angles of about 45 degrees relative the surface 131 of the target 112, or within a range of about 35 to 55 degrees. In embodiments wherein the cutting edges 116A, 116B are 90 degrees (e.g. 90 degrees between the planes 182A, 182B and the faces 158) leading angle 194 and trailing angle 190 total 90 degrees relative the surface 38. Thus, if for example, the leading edge is 50 degrees then the corresponding trailing edge will be 40 degrees. Additionally, in embodiments where the planes 182A, 182B are at 45 degrees relative to the surface 38 for example, and the flank angle 126 is 10 degrees the cutting angle 127 will be 35 degrees while the angle 130 (trailing angle of the support) will be 45 degrees.

Figure 10:
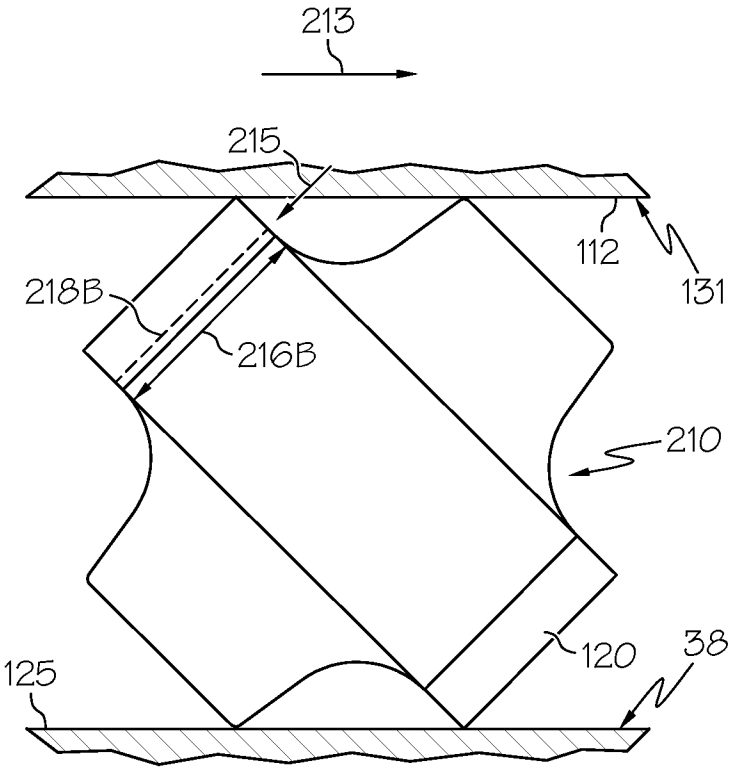
FIG. 10 depicts an alternate side view of the cutting element of FIG. 9.
Figure 9:
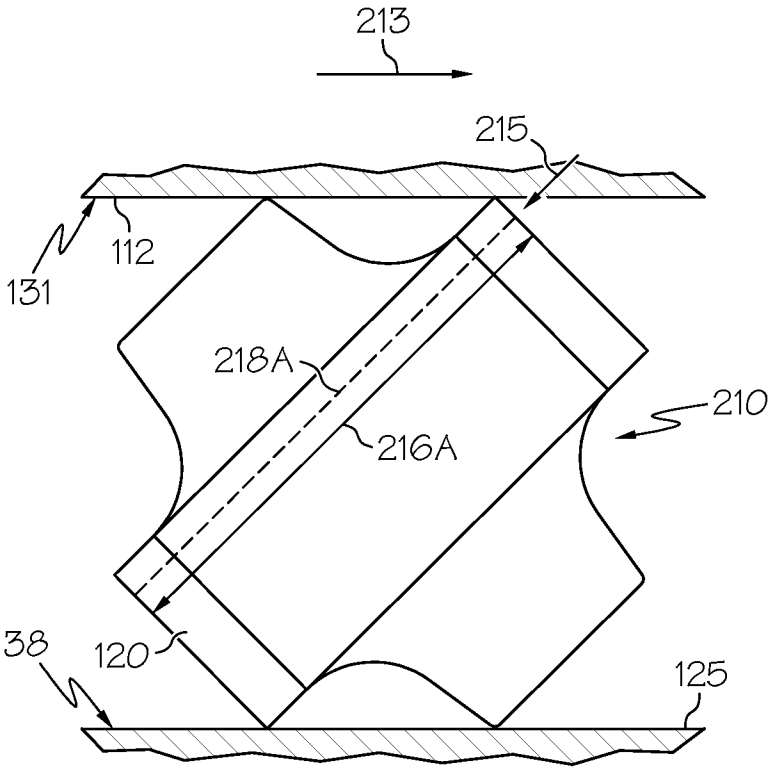
FIG. 9 depicts a side view of another cutting element disclosed herein.

Referring to FIGS. 9 and 10, the orientation of cutting element 210 relative to the cutter tool 125 to which it is attached will determine which of the angles 227, 230, 290 and 294 are leading and which are trailing. The cutting element 110 is attached to the cutter tool 125 in opposing orientations in FIGS. 9 and 10. A portion of the cutter tool 125 that the cutting element 210 is attached to moves relative to the surface 131 of the target 112 in the direction of arrow 213. A force in the direction of arrow 215 is applied to the cutting element 210 in response to relative motion between the element 210 and the cutter tool 125. The cutting element 210 distributes this force through a dimension 216A, 216B along dashed lines 218A, 218B of the modified gilmoid 120 illustrated. Since the dimension 216A is greater than the dimension 216B the force is distributed through a greater portion of the modified gilmoid 120 thereby decreasing stress in the modified gilmoid 120 and decreasing the likelihood that breaking and chipping of the modified gilmoid 120 will occur. Mounting of the cutting elements 210 to the cutter tool 125 in the orientation shown in FIG. 9 may improve durability of the cutter tool 125 and the cutting elements 210 attached thereto by reducing stresses in the modified gilmoid 120 that tend to promote fracturing thereof.

Figure 11:
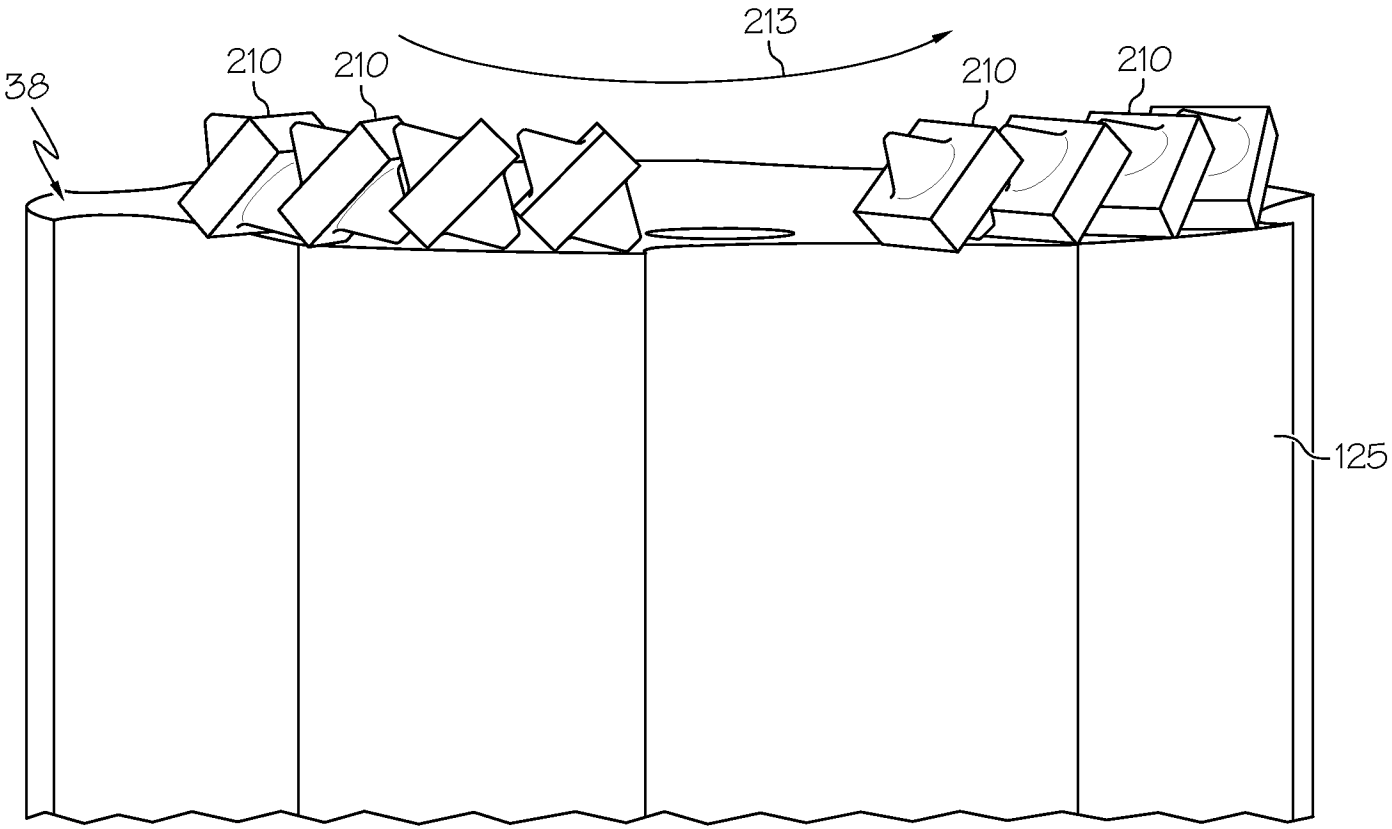
FIG. 11 depicts a partial perspective view of a cutter tool disclosed herein employing a plurality of the cutting elements of FIG. 9.

Referring to FIG. 11, a partial perspective view of the cutter tool 125 is illustrated with a plurality of the cutting elements 210 being positioned in a fashion similar to that illustrated in FIG. 9. Arrow 213 shows the direction of rotation of the cutter tool 125, thereby assuring that the cutting elements 210 move relative to the target 112 (not shown in this figure) in the direction illustrated in FIG. 9.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A cutting element, comprising a modified gilmoid having a plurality of surfaces two of which are planes, the two planes define a plurality of edges formed by intersections of the two planes with the plurality of surfaces of the modified gilmoid; and a first support extending from a central area of a first of the two planes and a second support extending from a central area of a second of the two planes, the first support being sized and positioned such that when the cutting element is resting against a planar surface due to gravity alone with one of the plurality of edges and the first support in contact with the planar surface, the first plane forms an acute angle with the planar surface.

2. The cutting element of claim 1, wherein the acute angle is between about 35 and 55 degrees.

3. The cutting element of claim 1, wherein the acute angle is about 45 degrees.

4. The cutting element of claim 1, wherein the planar surface is on a cutter tool.

5. The cutting element of claim 1, wherein the second support is configured to cut material that the second support contacts during movement thereof.

6. The cutting element of claim 1, wherein the second support has a pyramidal or conical shape having a base thereof attached to the second of the two planes.

7. The cutting element of claim 6, wherein a flank of the second support has a flank angle of between about 10 and 27 degrees.

8. The cutting element of claim 7, wherein the flank of the second support has a flank angle of 10 degrees thereby forming angles between faces of the second support and the planar surface of about 35 and 45 degrees.

9. The cutting element of claim 1, wherein the modified gilmoid is a regular polygonal prism.

10. The cutting element of claim 1, wherein the central area is less than 70 percent of each of the two planes.

11. The cutting element of claim 1, wherein the edges are cutting edges.

12. A cutter tool comprising:

a body with at least one planar surface; and a plurality of the cutting elements of claim 1 being attached to the at least one planar surface with a plurality of the plurality of cutting elements being oriented such that the first support and at least one edge of each of the plurality of cutting elements is in contact with the at least one planar surface.

13. The cutter tool of claim 12, wherein the at least one planar surface is rotational about an axis perpendicular to the planar surface.

14. The cutter tool of claim 12, wherein the cutter tool is a mill.

15. The cutter tool of claim 12, wherein a plurality of the plurality of cutting elements are oriented such that the second of the two planes of each of the plurality of cutting elements forms a trailing angle with a target to be cut by the cutter tool as defined by relative movement between the plurality of the plurality of cutting elements and the target as generated by movement of the cutter tool.

16. The cutter tool of claim 15, wherein orientation of the plurality of the plurality of cutting elements is configured to distribute cutting loads through the modified gilmoid to reduce fracture of the modified gilmoid.

17. A method of cutting within a borehole comprising:

rotating the cutter tool of claim 12 within a borehole;

contacting a target in the borehole with one or more of the plurality of cutting elements; and cutting the target.

18. The method of cutting within a borehole of claim 17, wherein the target is selected from the group consisting of earth, stone, metal, ceramic, polymers, monomers and combinations of the foregoing.

19. The method of cutting within a borehole of claim 17, wherein the borehole is a wellbore.

20. An apparatus for drilling subterranean formations, comprising:

a support surface;

a plurality of cutting elements for placement on the support surface, wherein each of the plurality of cutting elements include a base defined as a modified gilmoid having a peripheral upper end edge defined by intersections of surfaces of the modified gilmoid with at least one of the surfaces defined as a first plane having at least one first lateral support extending therefrom and a peripheral lower end edge defined by intersections of the surfaces of the modified gilmoid with at least one of the surfaces defined as a second plane having at least one second lateral support extending therefrom wherein the peripheral lower end edge engages the support surface and the peripheral upper end edge is disposed at a distance from the support surface, the base having the at least one second lateral support extending therefrom such that random placement of the plurality of cutting elements on the support surface results in at least some of the plurality of cutting elements being positioned such that the peripheral lower end edge and the at least one second lateral support is simultaneously in contact with the support surface at spaced locations on the support surface.

21. The apparatus of claim 20, wherein the first plane opposes the second plane.

22. The apparatus of claim 21, wherein the first plane and the second plane are parallel and at least one of the at least one first lateral support and the at least one second lateral support is asymmetrical relative to the plane to which the at least one of the at least one first lateral support and the at least one second lateral support is mounted.

23. The apparatus of claim 22, wherein weight of each of the plurality of cutting elements is distributed asymmetrically relative to the opposing planes.

24. The apparatus of claim 21, wherein the at least one first lateral support and the at least one second lateral support are substantially symmetrical.

25. The apparatus of claim 21, wherein the peripheral upper end edge and the peripheral lower end edge are cutting edges.

26. The apparatus of claim 21, wherein a radial dimension of a contact location of the at least one first lateral support and the at least one second lateral support to the base comprises between 40 and 80 percent of the radial dimension of the base.

27. The apparatus of claim 26, wherein the radial dimension of the contact location of the at least one first lateral support and the at least one second lateral support to the base comprises about 60 percent of the radial dimension of the base.

28. The apparatus of claim 21, wherein at least one first lateral support and the at least one second lateral support extend in directions such that an angle between axes of the at least one first lateral support and the at least one second lateral support is at least 120 degrees.

29. The apparatus of claim 21, wherein:

the at least one first lateral support and the at least one second lateral support have a pyramidal shape wherein a lower end of the pyramidal shape at the base comprises a dimension of 40 to 80 percent of the lateral dimension of the base.

30. The apparatus of claim 20, wherein the base is made of at least one of steel, tungsten carbide, tungsten carbide matrix, polycrystalline diamond, ceramics and combinations thereof.

31. The apparatus of claim 20, wherein the peripheral upper end edge and the peripheral lower end edge include substantially right angled corners.

32. The apparatus of claim 20, wherein the base comprises a polygonal prism.

33. The apparatus of claim 20 wherein:

the at least one second lateral support has a flank face at an angle of between about 15.6 and 29 degrees with respect to an axis of the at least one second lateral support.

34. The apparatus of claim 33, wherein:

the flank face is disposed at an angle of between about 19.4 and 26 degrees with respect to an axis of the at least one second lateral support.

35. The apparatus of claim 33, wherein:

the plurality of cutting elements are symmetrical such that an edge of each of the plurality of cutting elements that is positioned furthest from the support surface forms similar angles relative to the support surface.

36. The apparatus of claim 35, wherein:

the edge positioned furthest from the support surface cuts material including at least one of stone, earth and metal.

37. The apparatus of claim 20, wherein:

the base has parallel opposed polygonal surfaces that make and angle between about 35 and 55 degrees with the support surface when the base and the at least one second lateral support are in contact with the support surface.

38. The apparatus of claim 20, wherein:

the base and the at least one second lateral support comprising, steel, tungsten carbide, tungsten carbide matrix, ceramics and combinations including at least one of the foregoing, excluding polycrystalline diamond.

39. The apparatus of claim 20, wherein:

the support surface is planar.

40. The apparatus of claim 20, wherein:

distribution of the plurality of cutting elements on the support surface in a random orientation results in at least one point on the peripheral upper end edge of the base of each eating element being substantially a constant distance from the support surface.

41. The apparatus of claim 40, wherein:

the at least one point on the peripheral upper end edge of the base is substantially a constant distance from the support surface in which the at least one second lateral support is in contact.

42. The apparatus of claim 41, wherein:

all points on the peripheral upper end edge of each of the cutting elements are at the constant distance from the support surface in which the at least one second lateral support is in contact.

43. The apparatus of claim 20, wherein:

the peripheral upper end edge and the peripheral lower end edge are disposed on a cube shape having the first plane opposing the second plane that define a quadrilateral or polygonal shape.

44. The apparatus of claim 43, wherein:

the first plane and the second plane are parallel.

45. A plurality of cutting elements configured for placement on a support surface, the plurality of cutting elements each comprising:

a base having a peripheral upper end edge defined by intersections of surfaces of a modified gilmoid with at least one of the surfaces defined as a first plane having at least one first lateral support extending therefrom and a peripheral lower end edge defined by intersections of the surfaces of the modified gilmoid with at least one of the surfaces defined as a second plane having at least one second lateral support extending therefrom wherein the peripheral lower end edge engages the support surface and the peripheral upper end edge is disposed at a distance from the support surface, the base having the at least one second lateral support extending therefrom such that random placement of the plurality of cutting elements on the support surface results in at least some of the peripheral lower end edges and the at least one second lateral support being simultaneously in contact with the support surface at spaced locations on the support surface.

46. The plurality of cutting elements of claim 45, wherein:

distribution of the plurality of cutting elements on the support surface in a random orientation results in at least one point on the peripheral upper end edges of the base of each of the cutting elements being substantially a constant distance from the support surface.

47. The apparatus of claim 46, wherein:

the at least one point on the peripheral upper end edges of the bases are substantially a constant distance from the support surface for all the plurality of cutting elements in which the at least one second lateral support is in contact with the support surface.

48. The apparatus of claim 47, wherein:

all points on the peripheral upper end edges of the plurality of cutting elements are at the constant distance from the support surface in which the at least one first and the at least one second lateral supports are out of contact with the support surface.

* * * * *